US008950075B2

(12) United States Patent
Huang

(10) Patent No.: US 8,950,075 B2
(45) **Date of Patent: *Feb. 10, 2015**

(54) COMPOUND ACTION SNIPS

(75) Inventor: Hsin-Te Huang, Taichung (TW)

(73) Assignee: AllProfessional Mfg. Co., Ltd, Taichung (TW)

( * ) Notice: Subject to any disclaimer, the term of this patent is extended or adjusted under 35 U.S.C. 154(b) by 234 days.

This patent is subject to a terminal disclaimer.

(21) Appl. No.: 13/556,267

(22) Filed: Jul. 24, 2012

(65) Prior Publication Data

US 2013/0232798 A1 Sep. 12, 2013

Related U.S. Application Data

(63) Continuation-in-part of application No. 13/413,708, filed on Mar. 7, 2012.

(30) Foreign Application Priority Data

Apr. 20, 2012 (TW) ..... 101114123 A

(51) Int. Cl.
*B26B 13/16* (2006.01)

(52) U.S. Cl.
USPC ..... 30/252; 30/262

(58) Field of Classification Search
USPC ..... 30/186–188, 190, 191, 193, 244–252, 30/254, 262; D8/5, 52
See application file for complete search history.

(56) References Cited

U.S. PATENT DOCUMENTS

| | | | | |
|---|---|---|---|---|
| 1,818,237 | A | 8/1931 | Medean, Jr. | 30/193 |
| 2,504,766 | A | 4/1950 | Vosbikian | 30/262 |
| 2,655,722 | A | 10/1953 | Klent | 30/252 |
| 3,839,794 | A | 10/1974 | Deale | 30/248 |
| D255,980 | S | 7/1980 | Winget | D8/52 |
| 4,439,923 | A | 4/1984 | Scranton | 30/252 |
| 4,967,475 | A | 11/1990 | O'Keeffee et al. | 30/252 |
| 5,003,695 | A | 4/1991 | Lipscomb et al. | 30/193 |
| D406,507 | S | 3/1999 | Mock | D8/52 |
| 6,189,219 | B1 | 2/2001 | Mock | 30/252 |
| 6,249,977 | B1 | 6/2001 | Knoop | 30/251 |
| D453,458 | S | 2/2002 | Huang | D8/57 |
| D457,791 | S | 5/2002 | Clivio | D8/5 |
| 6,408,523 | B1 * | 6/2002 | Schmidt | 30/254 |
| 6,574,870 | B1 | 6/2003 | Huang | 30/252 |
| 6,598,300 | B2 | 7/2003 | Huang | 30/262 |
| 6,752,054 | B2 | 6/2004 | Knight | 30/251 |
| D501,378 | S | 2/2005 | Tatic | D8/5 |
| D519,013 | S | 4/2006 | Schmick | D8/52 |

(Continued)

OTHER PUBLICATIONS

Taiwanese Utility Model Publication No. TW 410737, Nov. 1, 2000, 3 pages.

(Continued)

*Primary Examiner* — Jason Daniel Prone

(74) *Attorney, Agent, or Firm* — Alan D. Kamrath; Kamrath IP Lawfirm, P.A.

(57) ABSTRACT

Compound action snips include first and second handles pivotally connected to each other, and first and second blades. The first handle includes first and second walls arranged opposite to each other. The second wall includes a recess. The first blade is mounted to the first handle. The second blade is mounted to the second handle. A fastener inserts through the first wall, the first blade, and the second wall. A fixing element is received into the recess and is threaded onto the fastener, so that a top surface defined on the fixing element is not exposed out of the second wall of the first handle.

10 Claims, 17 Drawing Sheets

(56) References Cited

U.S. PATENT DOCUMENTS

| | | | | |
|---|---|---|---|---|
| D520,315 | S | 5/2006 | Deter | D8/52 |
| 7,346,991 | B1 | 3/2008 | Janson | 30/244 |
| D618,078 | S | 6/2010 | Cripps et al. | D8/52 |
| D623,498 | S | 9/2010 | Wong | D8/107 |
| D631,322 | S | 1/2011 | Wong | D8/52 |
| 7,895,757 | B1 | 3/2011 | Huang | 30/250 |
| 8,316,549 | B2 | 11/2012 | Musser | 30/262 |
| 8,327,549 | B2 | 12/2012 | Huang | 30/251 |
| D695,082 | S | 12/2013 | Huang | D8/5 |
| D696,568 | S | 12/2013 | Huang | D8/107 |
| 2004/0139616 | A1* | 7/2004 | Vogel | 30/260 |
| 2006/0137192 | A1 | 6/2006 | Deter | 30/248 |
| 2007/0163126 | A1 | 7/2007 | Huang | 30/178 |
| 2009/0172954 | A1 | 7/2009 | Novak et al. | 30/244 |
| 2013/0160301 | A1 | 6/2013 | Huang | 30/252 |
| 2013/0232797 | A1* | 9/2013 | Huang | 30/252 |
| 2013/0232798 | A1 | 9/2013 | Huang | 30/252 |

OTHER PUBLICATIONS

Chinese Utility Model Publication No. CN 202192320 U, Apr. 18, 2012, 12 pages.

* cited by examiner

COMPOUND ACTION SNIPS

The present application is a continuation-in-part application of U.S. patent application Ser. No. 13/413,708, filed on Mar. 7, 2012, of which the entire disclosure is incorporated herein.

BACKGROUND OF THE INVENTION

1. Field of the Invention

The present invention relates to compound action snips and, more particularly, to compound action snips able to cut an object without being interfered with by the object.

2. Description of the Related Art

U.S. Pat. No. 6,189,219 shows compound action snips including a pair of handles mutually connected at a second fastener and a pair of cutting blades connected to the handles. Each blade has a proximal end attached to a distal portion of one of the handles, and the blades are mutually connected at a blade pivot, so that converging movement of the handles causes converging movement of the blades. However, the second fastener exposed out of the external surface of the handle results in undesirable interference between the second fastener and an object being cut during cutting.

The present invention is, therefore, intended to obviate or at least alleviate the problems encountered in the prior art.

SUMMARY OF THE INVENTION

According to the present invention, compound action snips include first and second handles pivotally connected to each other, and first and second blades. The first handle includes first and second walls arranged opposite to each other. The second wall includes a recess. The first blade is mounted to the first handle. The second blade is mounted to the second handle. A fastener inserts through the first wall, the first blade, and the second wall. A fixing element is received into the recess and threaded onto the fastener, so that a top surface defined on the fixing element is not exposed out of the second wall of the first handle.

In view of the foregoing, it is an object of the present invention that the fixing element is received in the recess, so that the part of the object is not interfered with the by fixing element.

Other objects, advantages, and new features of the present invention will become apparent from the following detailed description of the invention when considered in conjunction with the accompanied drawings.

BRIEF DESCRIPTION OF THE DRAWINGS

For the present disclosure to be easily understood and readily practiced, the present disclosure will now be described for the purpose of illustration but not limitation, in conjunction with the following figures, wherein.

Figure 1:
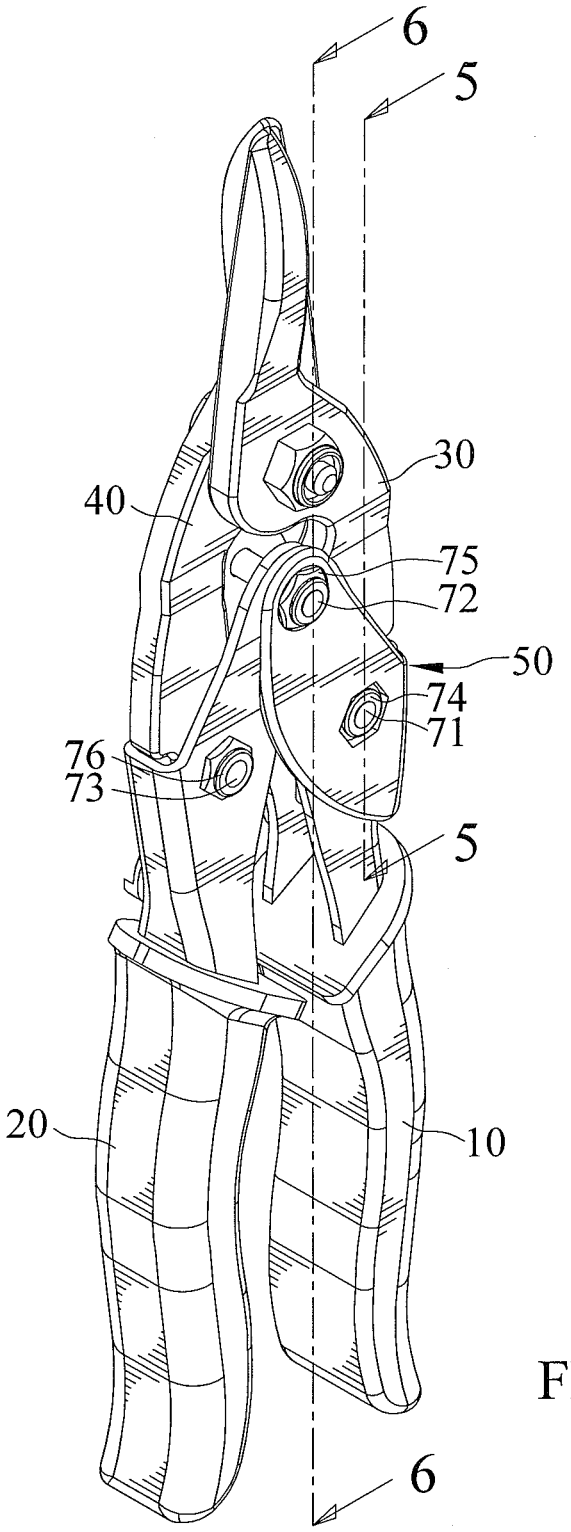
FIG. 1 is a perspective view of compound action snips in accordance with a first embodiment of the present invention, illustrating the snips in a closed position.
Figure 2:
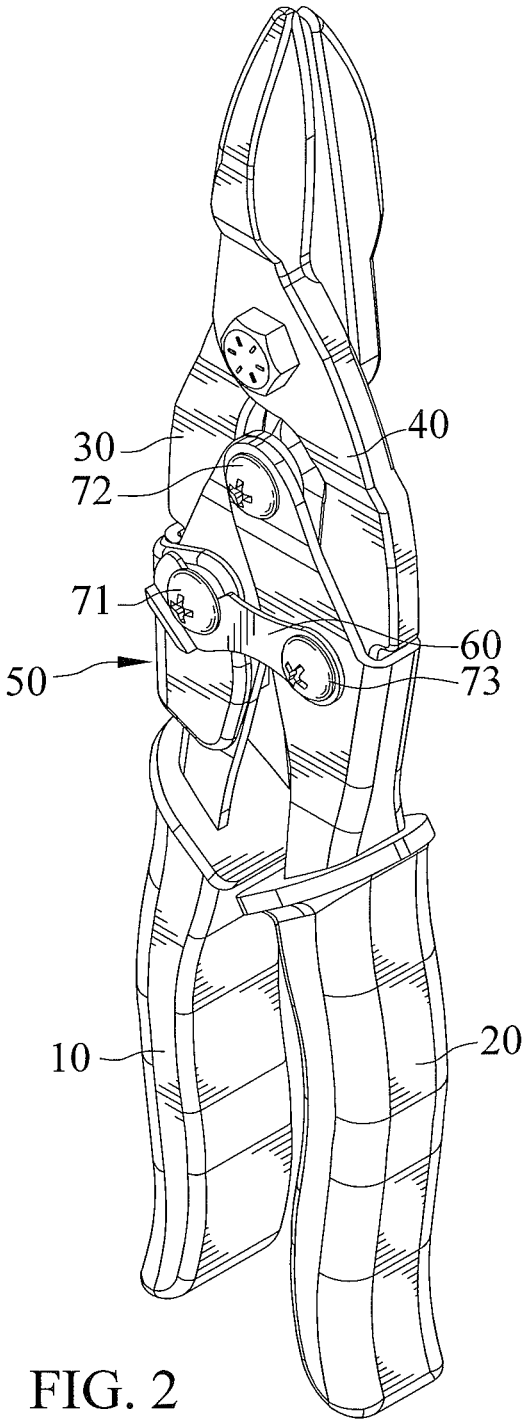
FIG. 2 is another perspective view of the snips of FIG. 1.
Figure 3:
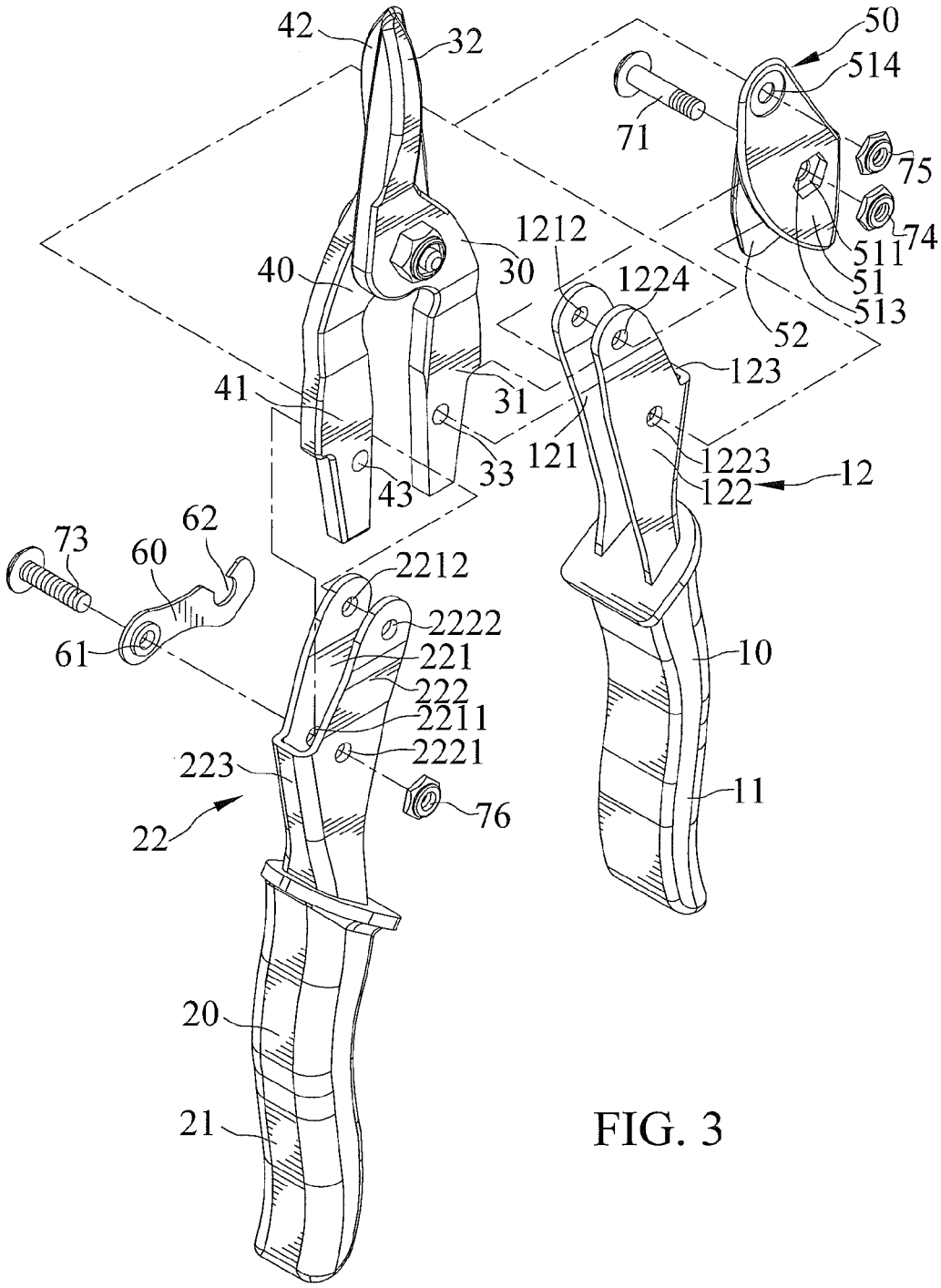
FIG. 3 is an exploded perspective view of the snips of FIG. 1.
Figure 4:
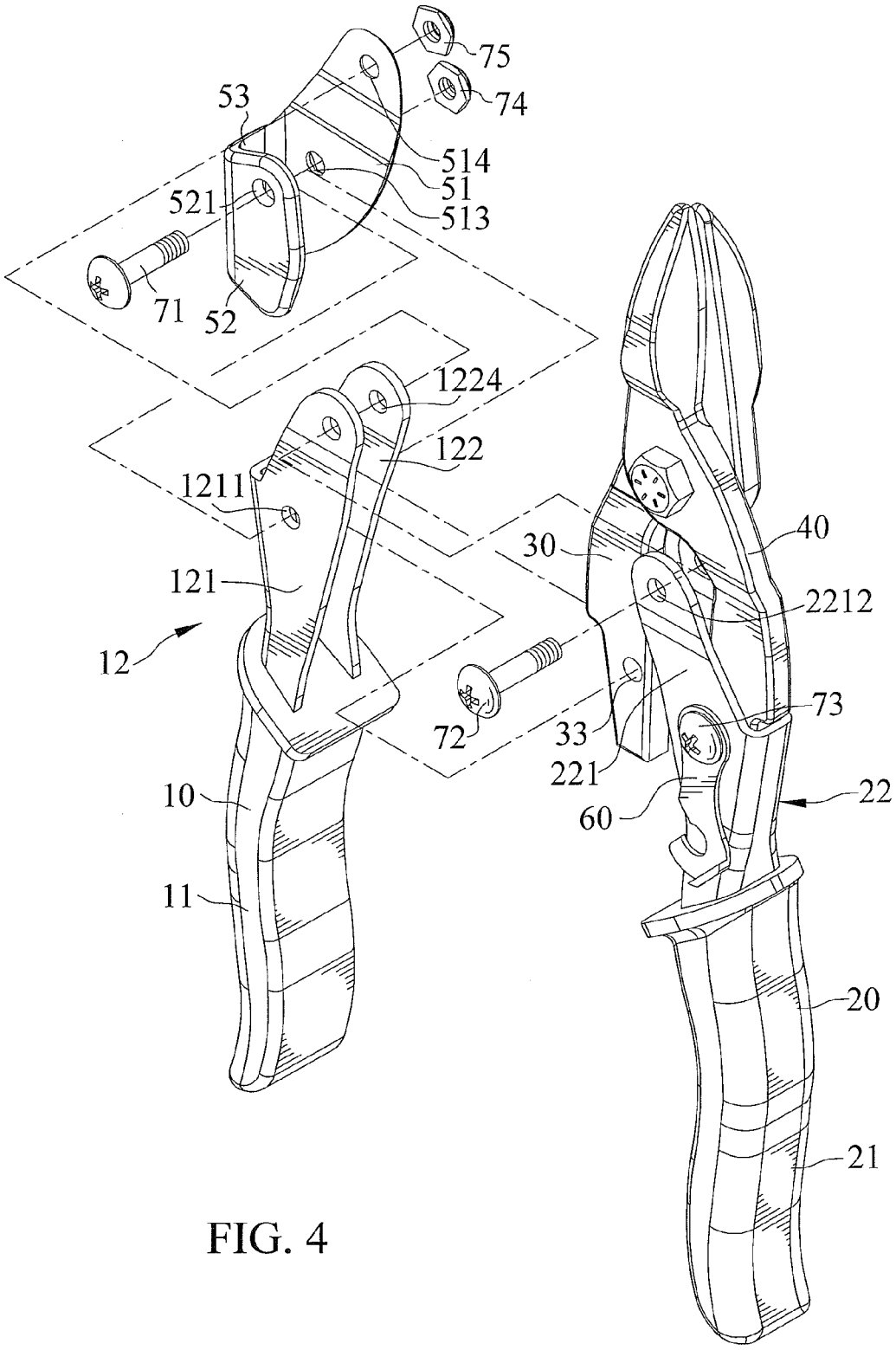
FIG. 4 is a partial, exploded perspective view of FIG. 2.
Figure 5:
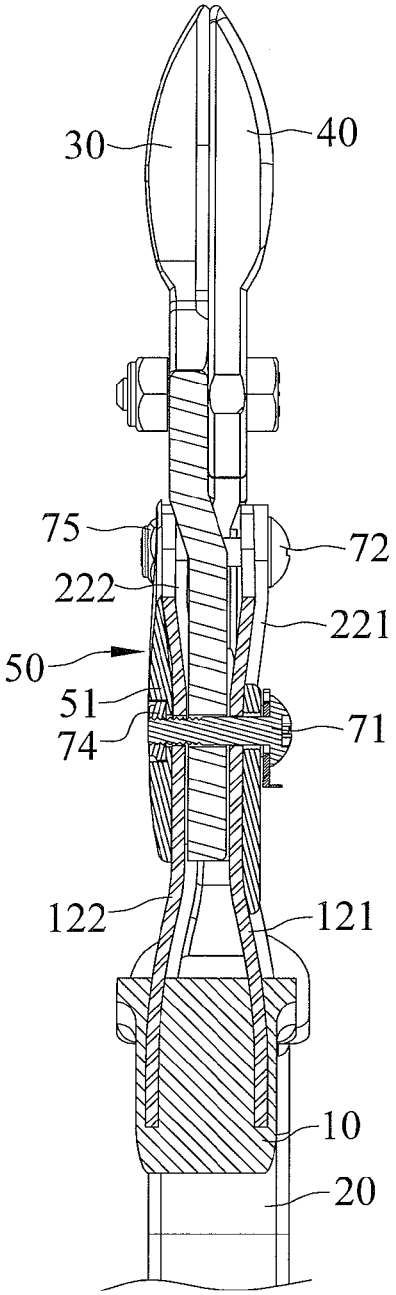
FIG. 5 is a cross sectional view taken along line 5-5 of the snips of FIG. 1.
Figure 6:
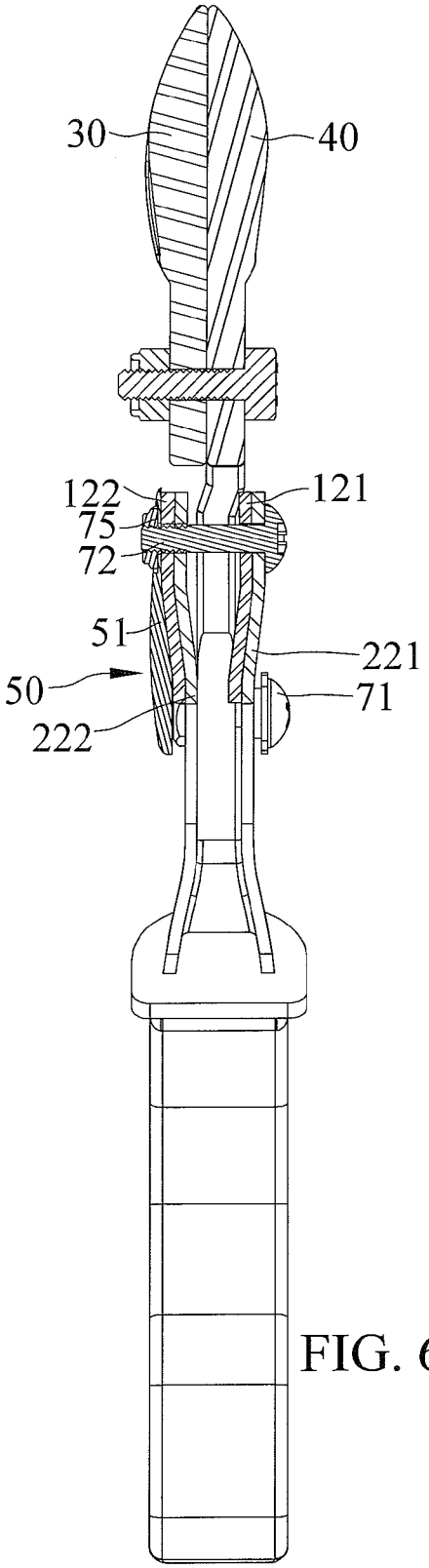
FIG. 6 is a cross sectional view taken along line 6-6 of the snips of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENTS

Referring to FIGS. 1 through 6, compound action snips according to the first embodiment of the present invention generally include first and second handles 10 and 20, first and second blades 30 and 40, and a nameplate 50 therein. The first and second handles 10 and 20 are mutually pivotally connected at a second fastener 72 fastened with a second fixing element 75. The first and second blades 30 and 40 are respectively mounted to the first and second handles 10 and 20 by first and third fasteners 71 and 73 respectively fastened with first and third fixing elements 74 and 76. The first, second, and third fasteners 71, 72, and 73 may comprise bolts, as shown in the figures, or any suitable fastener, and the first, second, and third fixing elements 74, 75, and 76 may comprise nuts.

The first handle 10 includes first distal and first proximal ends 11 and 12 disposed opposite to each other. The first distal end 11 allows a user to grip thereon. The first proximal end 12 is formed in a U-shape generally and includes first and second walls 121 and 122, and a first connecting wall 123 therein. The first and second walls 121 and 122 are arranged opposite to each other, and the first connecting wall 123 is disposed therebetween. The first wall 121 includes first and second holes 1211 and 1212, and the second wall 122 includes third and fourth holes 1223 and 1224. The first hole 1211 faces and is aligned with the third hole 1223. The second hole 1212 faces and is aligned with the fourth hole 1224.

The second handle 20 includes second distal and second proximal ends 21 and 22 disposed opposite to each other. The second distal end 21 allows the user to grip thereon. The second proximal end 22 is formed in a U-shape generally and includes third and fourth walls 221 and 222, and a second connecting wall 223 therein. The third and fourth walls 221 and 222 are arranged opposite to each other and the second connecting wall 223 is disposed therebetween. The third wall 221 includes fifth and sixth holes 2211 and 2212. The fourth wall 222 includes seventh and eighth holes 2221 and 2222 respectively facing and aligned with the fifth and sixth holes 2211 and 2212.

The first and second blades 30 and 40 are mutually connected at a blade pivot (not numbered) which allows relative pivoting movement of the first and second blades 30 and 40 to cut an object. The blade pivot is located distally of the second fastener 72. The snips have an open position in which the first and second handles 10 and 20 and the first and second blades 30 and 40 diverge from each other relative to the respective second fastener 72 and blade pivot. As may be understood by reference to the drawings, converging movement of the first and second handles 10 and 20, which is applied by the user, causes converging movement, that is, the cutting movement, of the first and second blades 30 and 40.

The first blade 30 includes a first connecting end 31 and a first cutting end 32. The first connecting end 31 is mounted to the first proximal end 12 and includes a ninth hole 33. The second blade 40 includes a second connecting end 41 and a second cutting end 42. The second connecting end 41 is mounted to the second proximal end 22 and includes a tenth hole 43. The first and second cutting ends 32 and 42 enable cutting the object.

The nameplate 50 is formed in a U-shape generally and is mounted on the first proximal end 12 of the first handle 10 to be able to display patterns, or trademarks provided thereon. The nameplate 50 includes fifth and sixth walls 51 and 52, and a third connecting wall 53 therein. The fifth and sixth walls 51 and 52 are arranged opposite to each other and respectively abut against the second and first walls 122 and 121 of the first handle 10, and the third connecting wall 53 is disposed therebetween and faces the first connecting wall 123. The fifth wall 51 includes a third recess 511, and eleventh and twelfth holes 513 and 514. The fifth wall 51 faces to the second wall 122. The sixth wall 52 includes a thirteenth hole 521 aligned with the first hole 1211. The eleventh hole 513 is disposed in a bottom of the third recess 511 and aligned with the thirteenth hole 521 and the third hole 1223. The third recess 511 is disposed at an outer surface of the fifth wall 51 opposite to the sixth wall 52. The twelfth hole 514 is aligned with the fourth hole 1224.

A latch 60 is pivotally mounted to the third fastener 73 and abuts against the third wall 221 of the second handle 20. The latch 60 includes an orifice 61 and a retaining portion 62 disposed at two opposite ends thereof The retaining portion 62 of the latch 60 can be buckled with the first fastener 71 mounted into the first handle 10 for holding the snips in a closed position, and abuts against the third wall 221 of the second handle 20.

In the embodiment, the first, second, and third fasteners 71, 72, and 73 are bolts, and the first, second, and third fasteners 74, 75, and 76 are nuts.

The first fastener 71 is sequentially inserted through the thirteenth hole 521 of the sixth wall 52, the first hole 1211 of the first wall 121, the ninth hole 33 of the first blade 30, the third hole 1223 of the second wall 122, and the eleventh hole 513 of the fifth wall 51. The first fixing element 74 is received into the third recess 511, so that a top surface defined on the first fixing element 74 is not exposed out of the fifth wall 51 of the nameplate 50. Moreover, the first fixing element 74 is threaded onto the first fastener 71 to fasten the first handle 10, the first blade 30, and the nameplate 50.

The second fastener 72 is sequentially inserted through the sixth hole 2212 of the third wall 221, the second hole 1212 of the first wall 121, the eighth hole 2222 of the fourth wall 222, the fourth hole 1224 of the second wall 122, and the twelfth hole 514 of the fifth wall 51. Moreover, the second fixing element 75 is threaded onto the second fastener 72, so that the first and second handles 10 and 20, and the nameplate 50 are pivotally connected with each other.

The third fastener 73 is sequentially inserted through to the orifice 61 of the latch 60, the fifth hole 2211 of the third wall 221, the tenth hole 43 of the second blade 40, and the seventh hole 2221 of the fourth wall 222. The third fixing element 76 abuts against the fourth wall 222 and is threaded onto the third fastener 73, so that the second handle 20 and the second blade 40 are connected with each other and so that the latch 60 is pivotally connected with the second handle 20.

Figure 7:
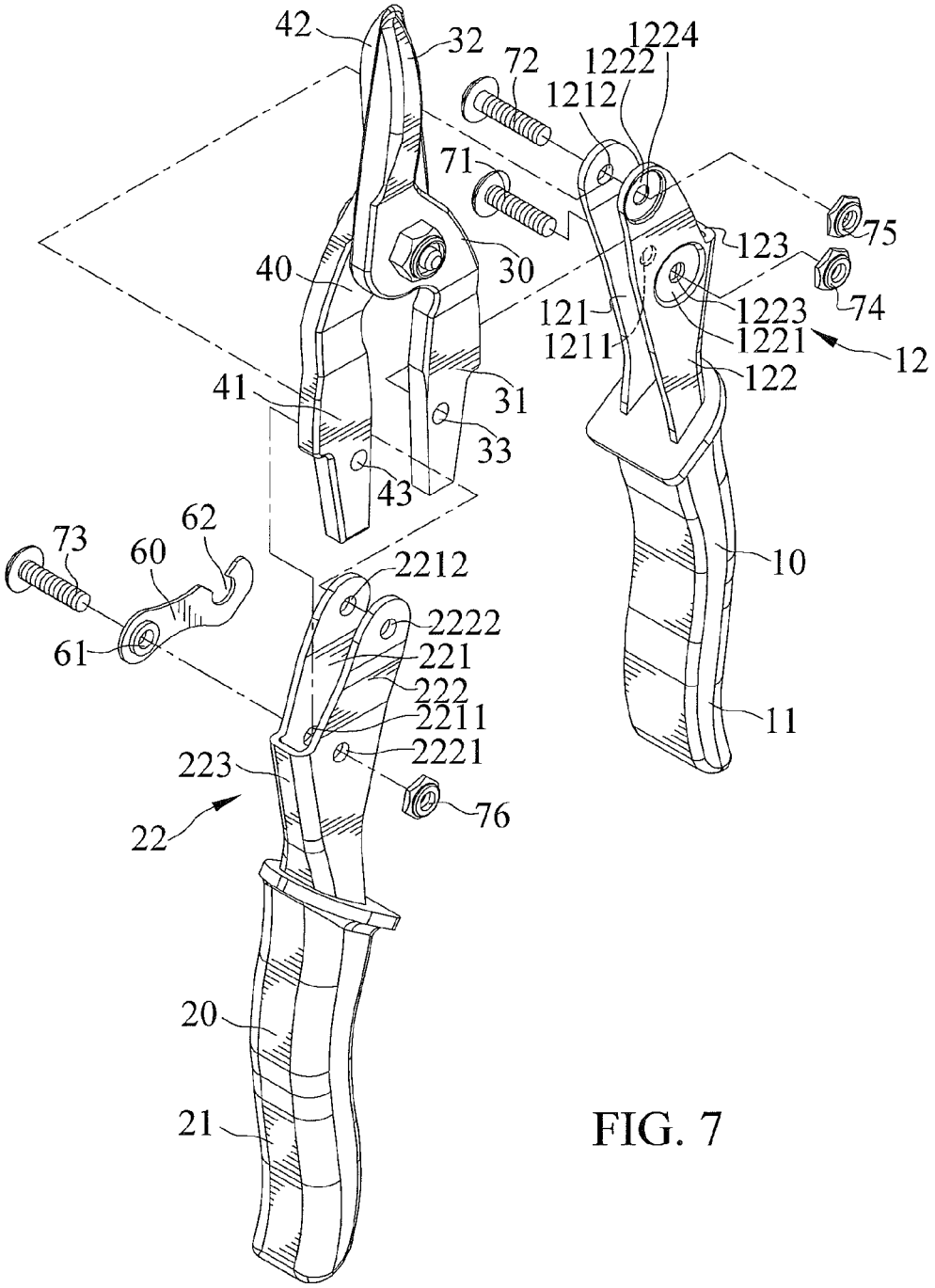
FIG. 7 is an exploded perspective view of the compound action snips in accordance with a second embodiment of the present invention.
Figure 8:
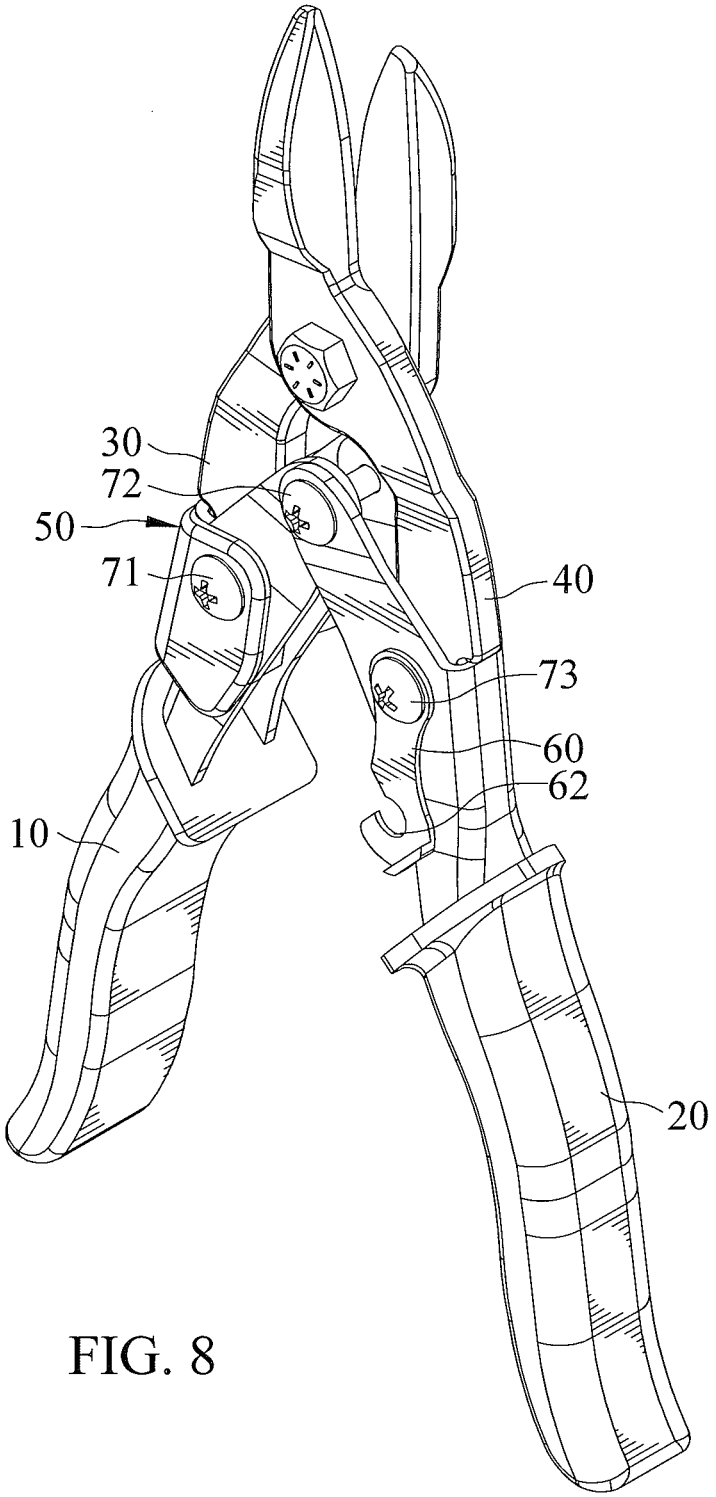
FIG. 8 is a perspective view of the snips of FIG. 2, illustrating the snips in an open position.
Figure 9:
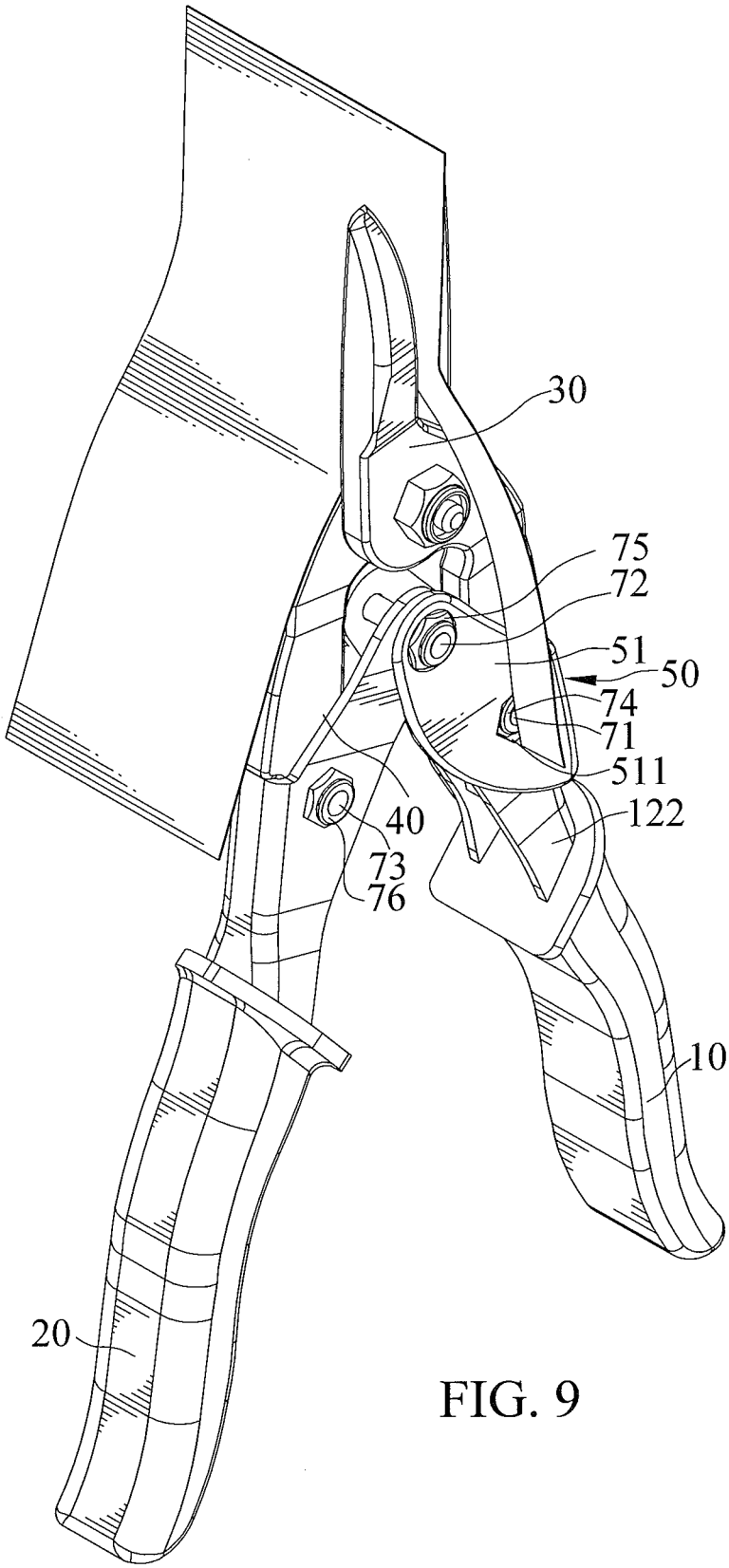
FIG. 9 is a perspective view of the snips of FIG. 8, illustrating the snips cutting an object.
Figure 10:
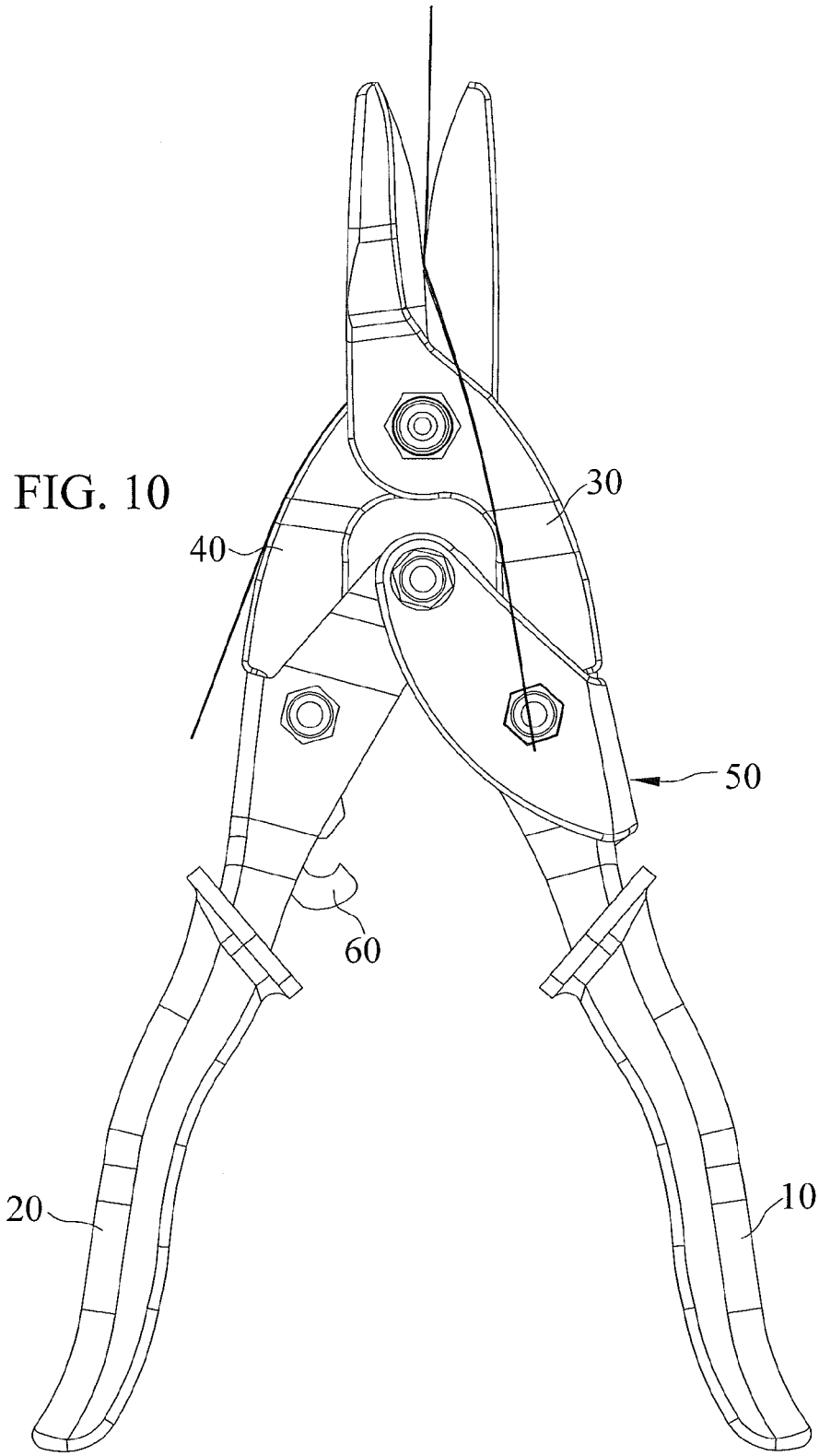
FIG. 10 is a front view of the snips of FIG. 9.
Figure 11:
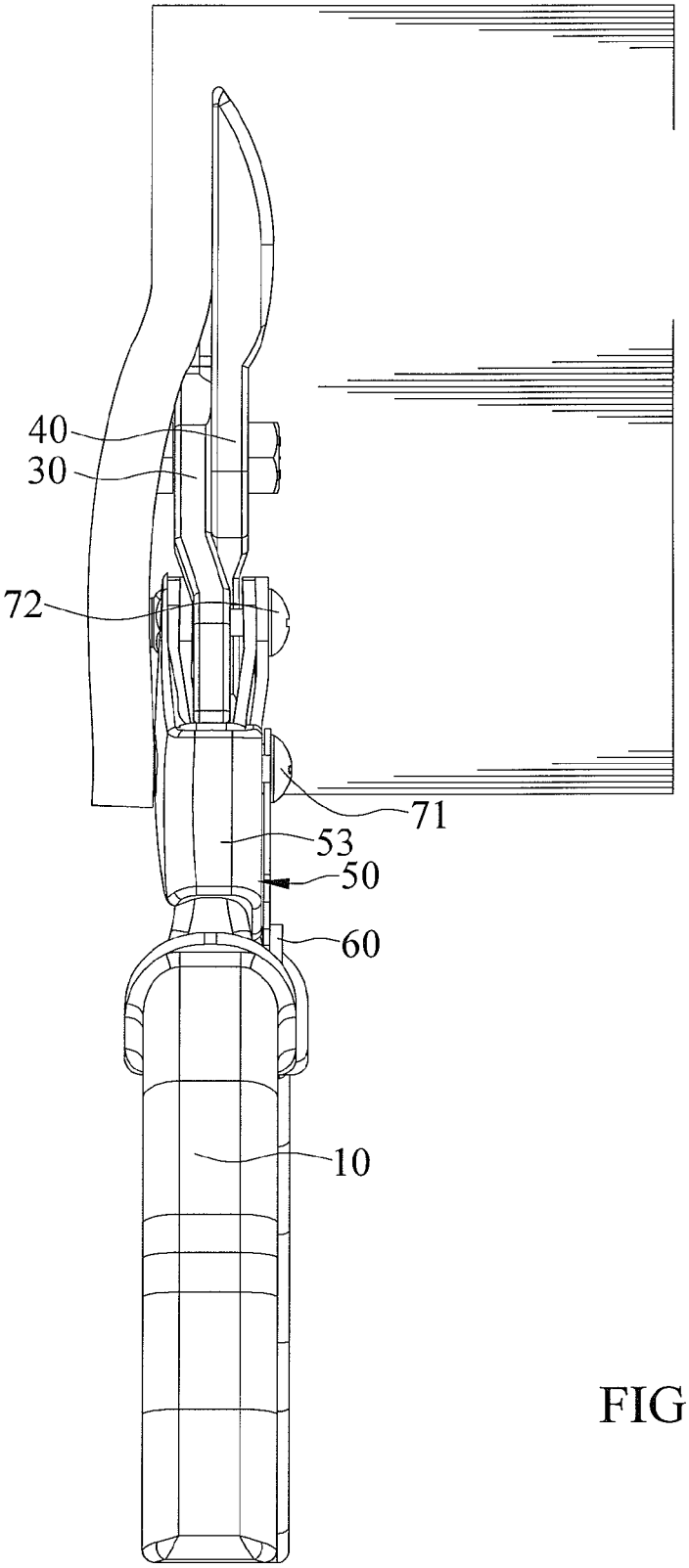
FIG. 11 is a side view of the snips of FIG. 9.
Figure 12:
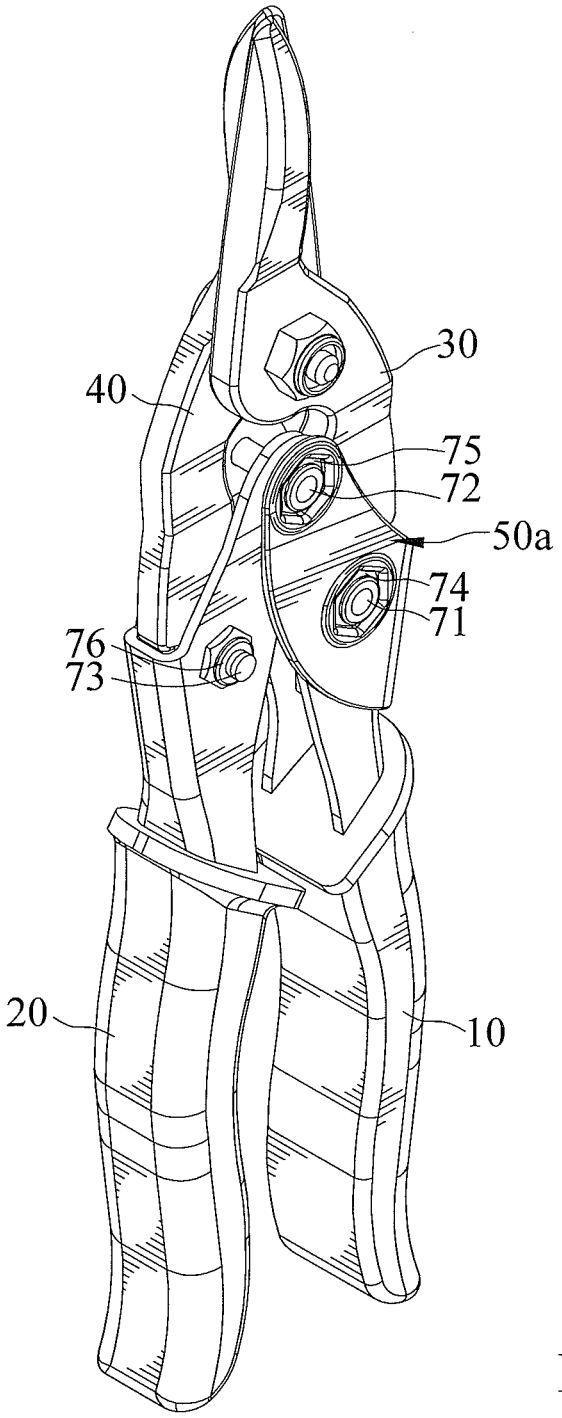
FIG. 12 is a perspective view of the snips in accordance with a third embodiment of the present invention.
Figure 13:
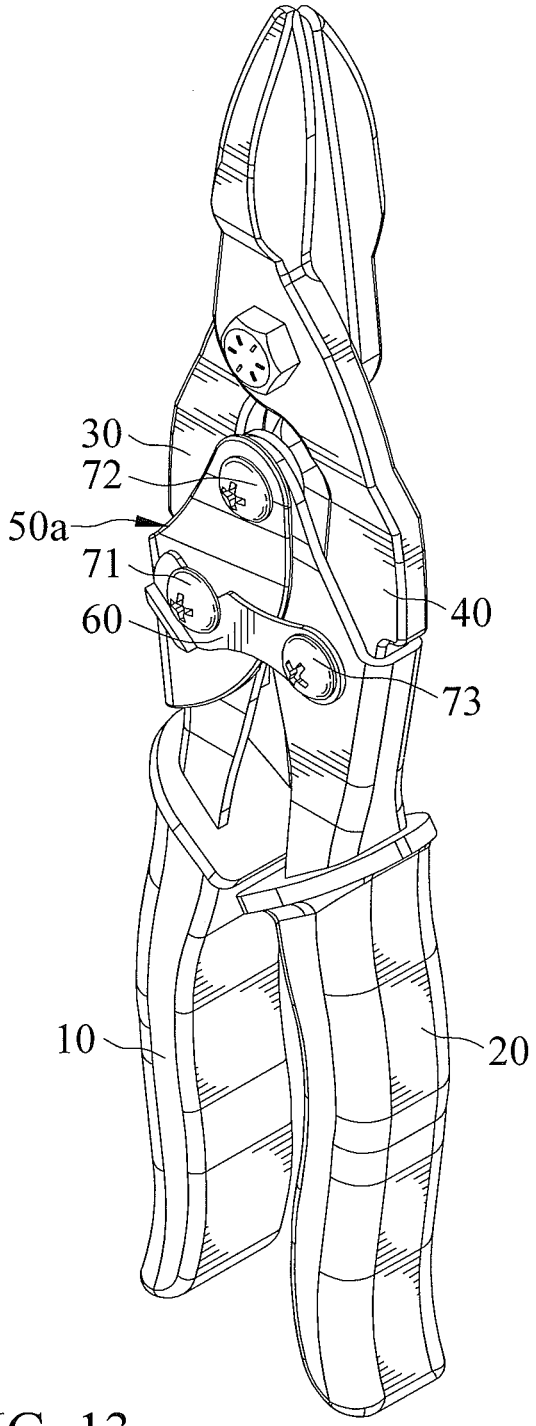
FIG. 13 is another perspective view of the snips of FIG. 12.
Figure 14:
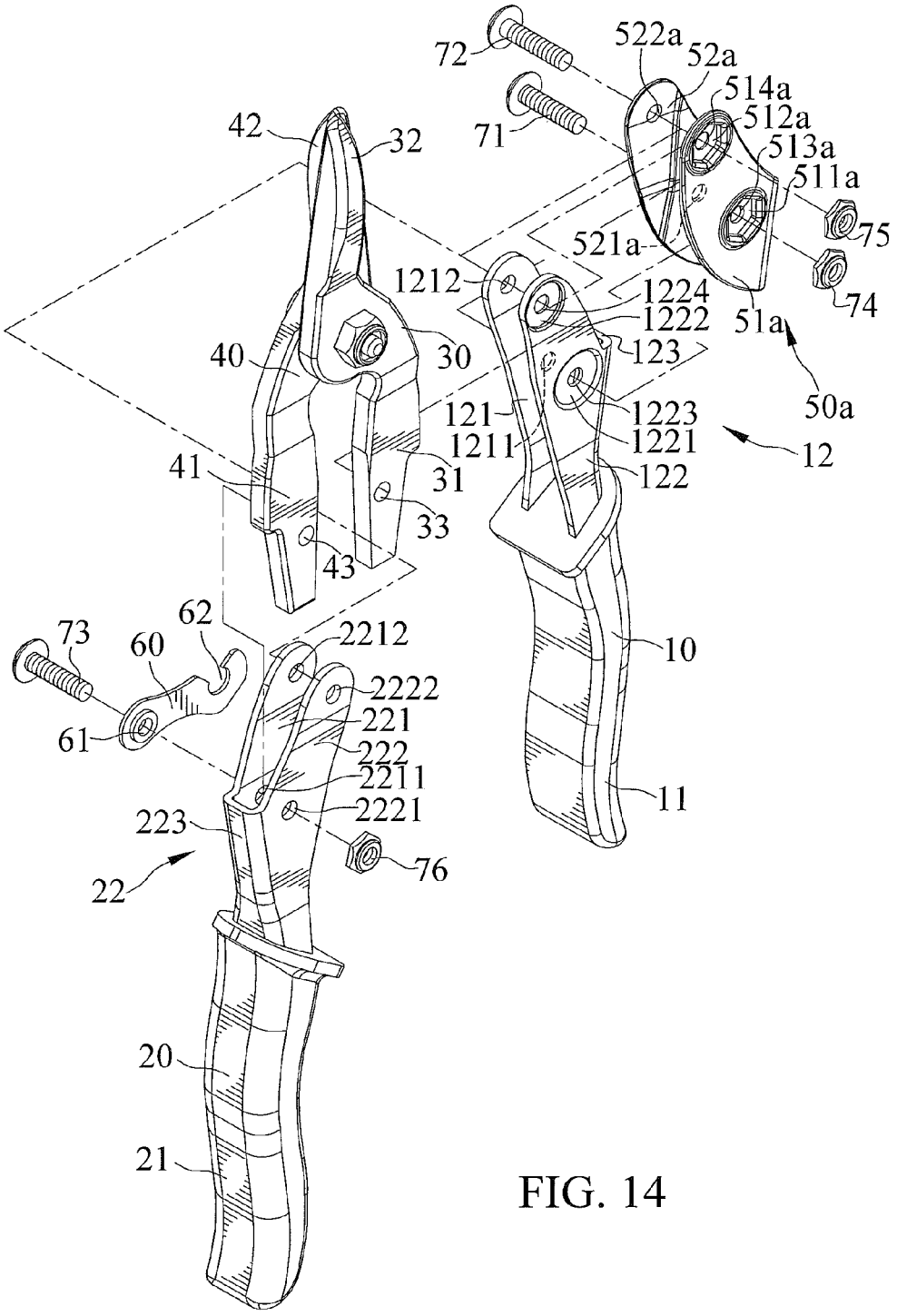
FIG. 14 is an exploded perspective view of the snips of FIG. 12.
Figure 15:
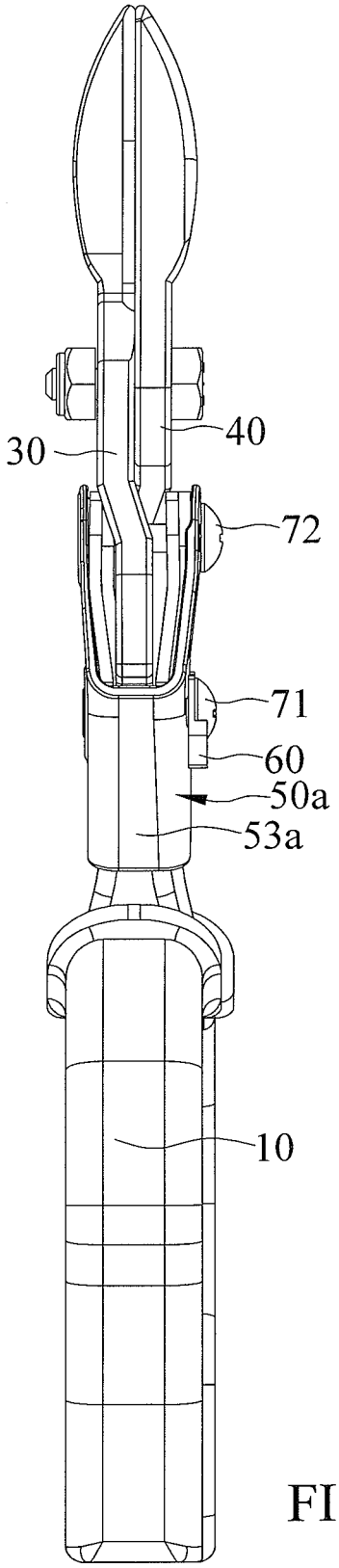
FIG. 15 is a side view of the snips of FIG. 13.
Figure 16:
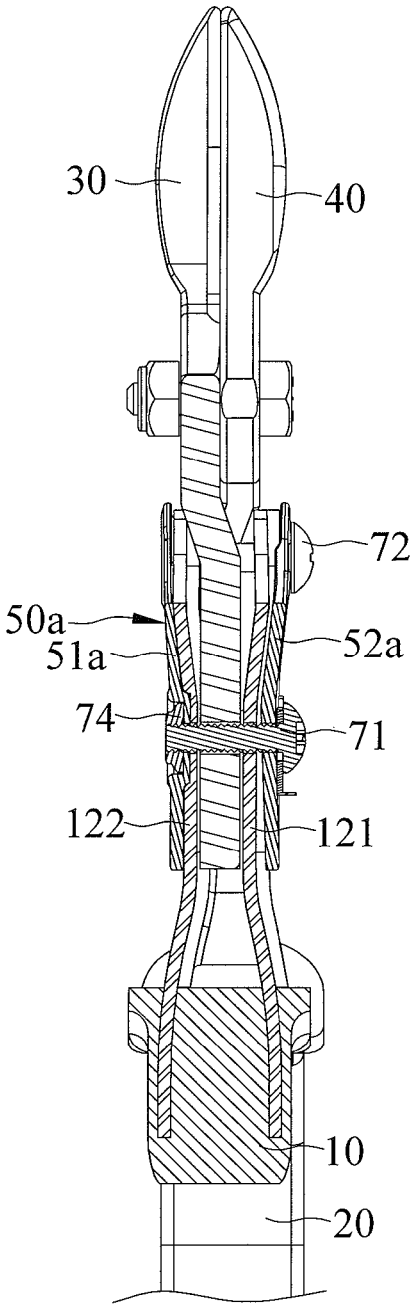
FIG. 16 is a partial, cross sectional view of FIG. 13.
Figure 17:
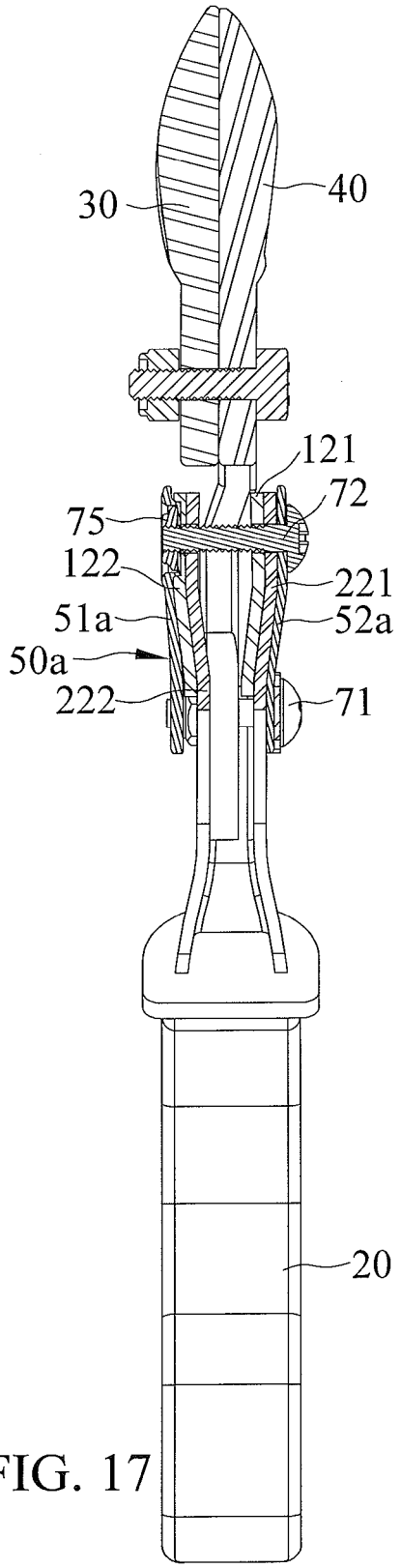
FIG. 17 is another cross sectional view of FIG. 13.

FIG. 7 shows snips in accordance with a second embodiment of the present invention. The second embodiment differentiates from the first embodiment in that it does not comprise the nameplate 50. The second wall 122 further includes first and second recesses 1221 and 1222. The first hole 1211 is arranged corresponding to the first recess 1221, and the second hole 1212 is arranged corresponding to the second recess 1222. The first and second recesses 1221 and 1222 are disposed on an outer surface of the second wall 122 opposite to the first wall 121.

The first fastener 71 is sequentially inserted through the first hole 1211 of the first wall 121, the ninth hole 33 of the first blade 30, and the third hole 1223 of the second wall 122. The first fixing element 74 is received in the first recess 1221 and is threaded onto the first fastener 71 to fasten the first handle 10 and the first blade 30, so that a top surface of the first fixing element 74 is not exposed out of the second wall 122.

The second fastener 72 is sequentially inserted through the second hole 1212 of the first wall 121, the sixth hole 2212 of the third wall 221, the eighth hole 2222 of the fourth wall 222, and the fourth hole 1224 of the second wall 122. The second fixing element 75 is received in the second recess 1222 and is threaded onto the second fastener 72 to pivotally connect the first and second handles 10 and 20 with each other, so that a top surface of the second fixing element 75 is not exposed out of the second wall 122.

Referring to FIGS. 8 through 11, the retaining portion 62 of the latch 60 selectively buckles with an end of the first fastener 71 disposed opposite the first fixing element 74 to hold the snips in the open or closed position. When the snips cut an object through a straight path, a part of the object is formed adjacent to a side of the first blade 30 and the fifth wall 51 of the nameplate 50 or the second wall 122 of the first handle 10 (shown in FIGS. 7, 9 and 11). The first and second fixing elements 74 and 75 are respectively received in the first and second recesses 1221 and 1222, so that the part of the object formed adjacent to the side of the first blade 30 and the fifth wall 51 or the second wall 122 of the first handle 10 does not interfere with the first and second fixing elements 74 and 75.

FIGS. 12 through 17 show snips in accordance with a third embodiment of the present invention. The structure of the snips with the third embodiment is similar to the first embodiment substantially except the nameplate 50*a*. The nameplate 50*a* mounted on the first proximal end 12 of the first handle 10 is formed in a U-shape generally and includes fifth and sixth walls 51 a and 52*a*, and a third connecting wall 53*a* therein. The fifth and sixth walls 51*a* and 52*a* are arranged opposite to each other and respectively abut against the second and first walls 122 and 121 of the first handle 10, and the third connecting wall 53*a* is disposed therebetween and faces the first connecting wall 123. The fifth wall 51*a* includes third and fourth recesses 511*a* and 512*a* both formed inward in a hexagonal shape and disposed on a surface thereof, and eleventh and twelfth holes 513*a* and 514*a*. The sixth wall 52*a* includes thirteenth and fourteenth holes 521*a* and 522*a* respectively aligned with the first and second holes 1211 and 1212 at two distal ends thereof. The eleventh hole 513*a* is disposed in a bottom of the third recess 511 a and aligned with the thirteenth hole 521*a* and the third hole 1223. The twelfth hole 514*a* is disposed in a bottom of the fourth recess 512*a* and aligned with the fourteenth hole 522*a* and the fourth hole 1224. The third and fourth recesses 511*a* and 512*a* are disposed at an outer surface of the fifth wall 51 a opposite to the sixth wall 52*a*. The fifth and sixth walls 51 a and 52*a* are arranged opposite to each other and respectively abut against the second and first walls 122 and 121 of the first handle 10, and the third connecting wall 53*a* is disposed therebetween and faced to the first connecting wall 123. The third and fourth recesses 511*a* and 512*a* respectively align with the first and second recesses 1221 and 1222.

The first fastener 71 is sequentially inserted through the thirteenth hole 521*a* of the sixth wall 52*a*, the first hole 1211 of the first wall 121, the ninth hole 33 of the first blade 30, the third hole 1223 of the second wall 122, and the eleventh hole 513*a* of the fifth wall 51*a*. The first fixing element 74 is received into the third recess 511*a* of the nameplate 50*a* and is threaded onto the first fastener 71 to fasten the first handle 10, the first blade 30, and the nameplate 50, so that a top surface defined on the first fixing element 74 is not exposed out of the fifth wall 51*a* of the nameplate 50*a*.

The second fastener 72 is sequentially inserted through the fourteenth hole 522*a* of the sixth wall 52*a*, the second hole 1212 of the first wall 121, the sixth hole 2212 of the third wall 221, the eighth hole 2222 of the fourth wall 222, the fourth hole 1224 of the second wall 122, and the twelfth hole 514*a* of the fifth wall 51*a*. Moreover, the second fixing element 75 is received in the fourth recess 512*a* of the nameplate 50*a* and threaded onto the second fastener 72 to pivotally connect the first and second handles 10 and 20 with each other, so that a top surface of the second fixing element 75 is not exposed out of the fifth wall 51*a* of the nameplate 50*a*.

Figure 18:
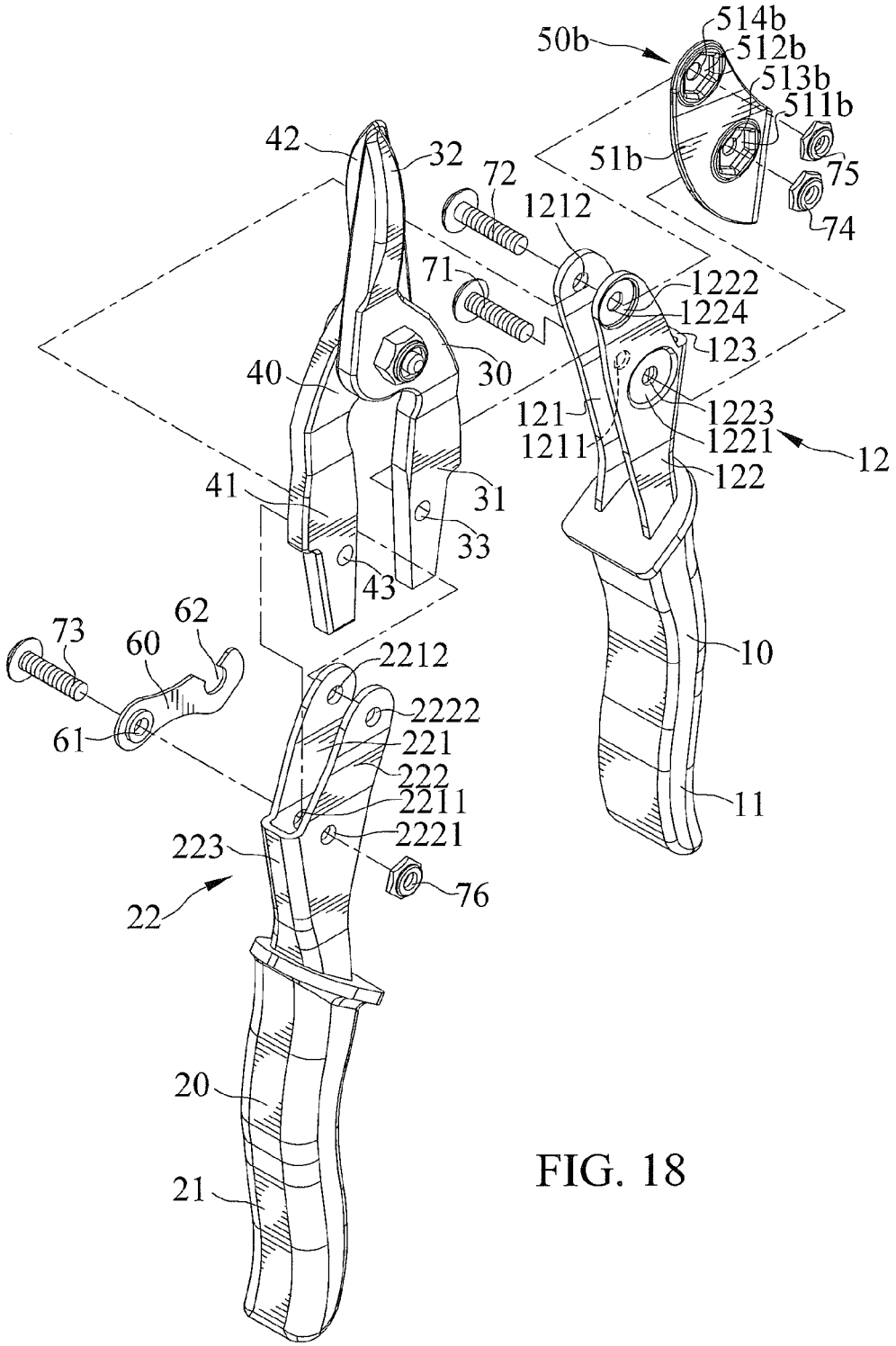
FIG. 18 is an exploded perspective view of the compound action snips in accordance with a fourth embodiment of the present invention.

FIG. 18 shows snips in accordance with a fourth embodiment of the present invention. The structure of the snips with the fourth embodiment is similar to the first embodiment substantially except the nameplate 50*b*. However, the nameplate 50*b* includes fifth wall 51*b* abutted against the second wall 122 of the first proximal end 12. The fifth wall 51*b* includes third and fourth recesses 511*b* and 512*b* disposed on a surface thereof, and eleventh and twelfth holes 513*b* and 514*b*. The eleventh hole 513*b* is disposed in a bottom of the third recess 511*b* and aligned with the third hole 1223. The twelfth hole 514*b* is disposed in a bottom of the fourth recess 512*b* and aligned with the fourth hole 1224.

The first fastener 71 is sequentially inserted through the first hole 1211 of the first wall 121, the ninth hole 33 of the first blade 30, the third hole 1223 of the second wall 122, and the eleventh hole 513*b* of the fifth wall 51*b*. The first fixing element 74 is received into the third recess 511*b* of the nameplate 50*b* and threaded onto the first fastener 71 to fasten the first handle 10, the first blade 30, and the nameplate 50, so that a top surface defined on the first fixing element 74 is not exposed out of the fifth wall 51*b* of the nameplate 50*b*.

The second fastener 72 is sequentially inserted through the second hole 1212 of the first wall 121, the sixth hole 2212 of the third wall 221, the eighth hole 2222 of the fourth wall 222, the fourth hole 1224 of the second wall 122, and the twelfth hole 514*b* of the fifth wall 51*b*. Moreover, the second fixing element 75 is received in the fourth recess 512*b* of the nameplate 50*b* is and threaded onto the second fastener 72 to pivotally connect the first and second handles 10 and 20 with each other, so that a top surface of the second fixing element 75 is not exposed out of the fifth wall 51*b* of the nameplate 50*b*.

Figure 19:
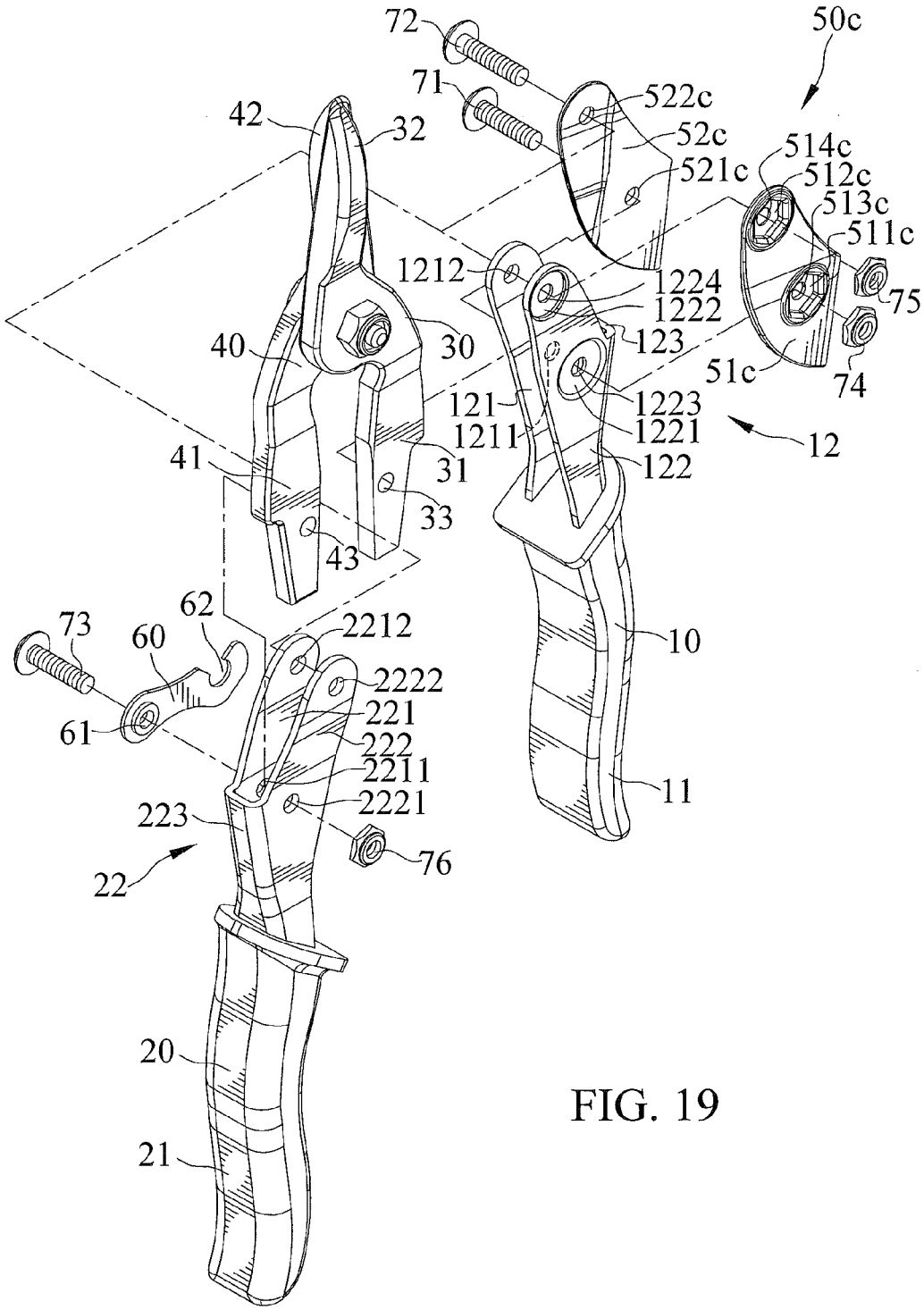
FIG. 19 is an exploded perspective view of the compound action snips in accordance with a fifth embodiment of the present invention.

FIG. 19 shows snips in accordance with a fifth embodiment of the present invention. The structure of the snips with the fifth embodiment is similar to the first embodiment substantially except the nameplate 50*c*. However, the nameplate 50*c* includes fifth and sixth walls 51*c* and 52*c* formed separately. The fifth wall 51*c* abuts against the second wall 122 of the first proximal end 12, and the sixth wall 52*c* abuts against the first wall 121 of the first proximal end 12. The fifth wall 51*c* includes third and fourth recesses 511*c* and 512*c* disposed on a surface thereof, and eleventh and twelfth holes 513*c* and 514*c*. The sixth wall 52*c* includes thirteenth and fourteenth holes 521*c* and 522*c*. The eleventh hole 513*c* is disposed in a bottom of the third recess 511 c and aligned with the thirteenth hole 521*c* and the third hole 1223. The twelfth hole 514*c* is disposed in a bottom of the fourth recess 512*c* and aligned with the fourteenth hole 522*c* and the fourth hole 1224.

The first fastener 71 is sequentially inserted through the thirteenth hole 521*c* of the sixth wall 52*c*, the first hole 1211 of the first wall 121, the ninth hole 33 of the first blade 30, the third hole 1223 of the second wall 122, and the eleventh hole 513*c* of the fifth wall 51*c*. The first fixing element 74 is received into the third recess 511*c*, so that a top surface defined on the first fixing element 74 is not exposed out of the fifth wall 51*c* of the nameplate 50*c*.

The second fastener 72 is sequentially inserted through the fourteenth hole 522*c* of the sixth wall 52*c*, the second hole 1212 of the first wall 121, the sixth hole 2212 of the third wall 221, the eighth hole 2222 of the fourth wall 222, the fourth hole 1224 of the second wall 122, and the twelfth hole 514*c* of the fifth wall 51*c*. Moreover, the second fixing element 75 is received in the fourth recess 512*c* of the nameplate 50*c* and is threaded onto the second fastener 72 to pivotally connect the first and second handles 10 and 20 with each other, so that a top surface of the second fixing element 75 is not exposed out of the fifth wall 51*c* of the nameplate 50*c*.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Compound action snips comprising:

a first handle including first distal and first proximal ends disposed opposite to each other, with the first proximal end including first and second walls arranged opposite to each other, with each of the first and second walls including a hole;

a second handle pivotally connected with the first handle and including second distal and second proximal ends disposed opposite to each other, with the second proximal end including third and fourth walls arranged opposite to each other, with each of the third and fourth walls including a hole;

a first blade including a first connecting end and a first cutting end, with the first connecting end located intermediate the first and second walls of the first proximal end of the first handle, with the first connecting end including a hole;

a second blade including a second connecting end and a second cutting end, with the second connecting end located intermediate the third and fourth walls of the second proximal end of the second handle, with the second connecting end including a hole, wherein the first and second cutting ends enable cutting an object;

a nameplate having a fifth wall abutted against the second wall of the first handle, with the fifth wall including a first recess and a hole;

a first fastener inserting through the holes of the first wall of the first proximal end of the first handle, the first connecting end of the first blade, the second wall of the first proximal end of the first handle and the fifth wall of the nameplate;

a first fixing element received through the first recess of the nameplate and engaged with the first fastener to fasten the first handle, the first blade and the nameplate;

a second fastener inserted through the holes of the third wall of the second proximal end of the second handle, the second connecting end of the second blade, and the fourth wall of the second proximal end of the second handle;

a second fixing element abutted against the fourth wall and threaded onto the threads of the second fastener; and a latch pivotally connected with the second fastener and selectively buckling with the first fastener between open and closed positions of the first and second blades;

wherein the nameplate includes a sixth wall abutted against the first wall of the first proximal end of the first handle, wherein a third fastener inserts through the holes of the third wall of the second proximal end of the second handle, the first wall of the first proximal end of the first handle, the fourth wall of the second proximal end of the second handle, the second wall of the first proximal end of the first handle, and the fifth wall of the nameplate, wherein a third fixing element is disposed at the fifth wall and engaged with the third fastener.

2. The compound action snips as claimed in claim 1, wherein the nameplate is substantially U-shaped and includes a first connecting wall therein, and wherein the first connecting wall is disposed between the fifth and sixth walls.

3. The compound action snips as claimed in claim 2, wherein the first, second, and third fasteners are bolts, and wherein the first, second, and third fixing elements are nuts.

4. The compound action snips as claimed in claim 2, wherein the latch abuts against the third wall of the second handle, wherein the latch includes an orifice and a retaining portion disposed at two opposite ends thereof, and wherein the retaining portion of the latch selectively buckles with an end of the first fastener disposed opposite the first fixing element to hold the first and second blades in the open or closed position.

5. The compound action snips as claimed in claim 2, wherein the first proximal end of the first handle includes a first connecting wall, wherein the first and second walls are arranged with the first connecting wall disposed therebetween, wherein the second proximal end includes a second connecting wall, and wherein the third and fourth walls are arranged with the second connecting wall disposed therebetween.

6. The compound action snips as claimed in claim 1, wherein the latch abuts against the third wall of the second handle, wherein the latch includes an orifice and a retaining portion disposed at two opposite ends thereof, and wherein the retaining portion of the latch selectively buckles with an end of the first fastener disposed opposite the first fixing element to hold the first and second blades in the open or closed position.

7. The compound action snips as claimed in claim 1, wherein the first proximal end of the first handle includes a first connecting wall, wherein the first and second walls are arranged with the first connecting wall disposed therebetween, wherein the second proximal end includes a second connecting wall, and wherein the third and fourth walls are arranged with the second connecting wall disposed therebetween.

8. The compound action snips as claimed in claim 1, wherein the first, second, and third fasteners are bolts, and wherein the first, second, and third fixing elements are nuts.

9. The compound action snips as claimed in claim 1, wherein the sixth wall includes a hole, wherein the fifth wall of the nameplate includes a second recess, wherein the third fastener inserts through the holes of the sixth wall of the nameplate, the first wall of the first proximal end of the first handle, the third and fourth walls of the second proximal end of the second handle, the second wall of the first proximal end of the first handle and the fifth wall of the nameplate, and wherein the third fixing element is received into the second recess and engaged with the third fastener.

10. The compound action snips as claimed in claim 1, wherein the fifth wall includes a second recess, and wherein the third fixing element is received into the second recess and engaged with the third fastener.

* * * * *